US009519244B2

(12) United States Patent
Yoshida et al.

(10) Patent No.: US 9,519,244 B2
(45) Date of Patent: Dec. 13, 2016

(54) INTERMEDIATE TRANSFER BELT WITH ELASTIC LAYER FORMED ON BASE LAYER AND IMAGE FORMING APPARATUS INCLUDING SAME

(71) Applicant: Konica Minolta, Inc., Tokyo (JP)

(72) Inventors: Eiichi Yoshida, Tokyo (JP); Sadaaki Sakamoto, Tokyo (JP); Ryo Nakayama, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/961,288

(22) Filed: Dec. 7, 2015

(65) Prior Publication Data

US 2016/0170332 A1 Jun. 16, 2016

(30) Foreign Application Priority Data

Dec. 11, 2014 (JP) ..... 2014-250656

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/162
USPC ..... 399/302, 308, 121
See application file for complete search history.

(56) References Cited

U.S. PATENT DOCUMENTS

| | | | | |
|---|---|---|---|---|
| 6,044,243 | A | 3/2000 | Hara | |
| 2009/0148201 | A1* | 6/2009 | Sawai | G03G 15/162 399/302 |
| 2010/0021216 | A1* | 1/2010 | Sawai | G03G 15/162 399/302 |

FOREIGN PATENT DOCUMENTS

JP 3248455 B2 11/2001

* cited by examiner

*Primary Examiner* — Billy Lactaoen
(74) *Attorney, Agent, or Firm* — Lucas & Mercanti, LLP

(57) ABSTRACT

To provide an intermediate transfer belt having a high ability to transfer images to recording media with irregular surface, and an image forming apparatus including the intermediate transfer belt. The intermediate transfer belt includes a base layer and an elastic layer formed on the base layer, the elastic layer being formed of a rubber composition, wherein the intermediate transfer belt satisfies a specific relational expression.

4 Claims, 1 Drawing Sheet

INTERMEDIATE TRANSFER BELT WITH ELASTIC LAYER FORMED ON BASE LAYER AND IMAGE FORMING APPARATUS INCLUDING SAME

CROSS REFERENCE TO RELATED APPLICATIONS

This application is entitled to and claims the benefit of Japanese Patent Application No. 2014-250656 filed on Dec. 11, 2014, the disclosure of which including the specification, drawings and abstract is incorporated herein by reference in its entirety.

BACKGROUND OF THE INVENTION

1. Field of the Invention

The present invention relates to intermediate transfer belts and image forming apparatus, and more specifically to intermediate transfer belts applicable to electrophotographic image forming apparatus, and image forming apparatus including the intermediate transfer belt.

2. Description of Related Art

Heretofore, electrophotographic image forming apparatus are configured to visualize electrostatic latent images formed on electrostatic latent image bearing members (photoconductors) by development with toner, temporarily retain the resultant toner images on an intermediate transfer belt, and transfer the toner images formed on the intermediate transfer belt to a recording medium such as paper. One exemplary intermediate transfer belt applicable to such image forming apparatus has a base layer and an elastic layer which is formed on the surface of the base layer and which is formed of a rubber composition (see, e.g., Japanese Patent No. 3248455). In an image forming apparatus equipped with such an intermediate transfer belt, even when recording media with irregular surface (e.g., embossed paper) are employed, the intermediate transfer belt deforms to follow the surface irregularities thus exhibiting a superior ability to transfer images to recording media and being expected to provide high-quality visible images.

It has been found, however, that image forming apparatus equipped with an intermediate transfer belt having an elastic layer cannot always provide high-quality visible images depending on the image pattern of the visible image to be formed. Such a problem is noticeable when the visible image to be formed includes a black halftone image.

SUMMARY OF THE INVENTION

The present invention has been accomplished in light of the foregoing circumstances in the art. The inventors conducted extensive studies and consequently established that the foregoing problem pertinent in image forming apparatus equipped with the conventional intermediate transfer belt having an elastic layer arises from changes in transfer electric field that occur due to the presence of the elastic layer. The present invention has been accomplished as a result of further extensive studies by the inventors to solve the problem. An object of the present invention is to provide an intermediate transfer belt that has a high ability to transfer images to recording media with irregular surface, and an image forming apparatus equipped with the intermediate transfer belt.

An intermediate transfer belt according to an embodiment of the present invention includes a base layer and an elastic layer formed on the base layer, the elastic layer being formed of a rubber composition, wherein the intermediate transfer belt satisfies the following Expression (1):

$$1.30 \leq [\mathrm{Log}(\rho v100)/\mathrm{Log}(\rho v1000)] \leq 2.50 \qquad \text{Expression (1)}$$

where ρv100 represents a volume resistivity [Ω·cm] of the intermediate transfer belt when a voltage of 100V is applied to the intermediate transfer belt in a thickness direction thereof, and ρv1000 represents a volume resistivity [Ω·cm] of the intermediate transfer belt when a voltage of 1000V is applied to the intermediate transfer belt in the thickness direction thereof.

In the intermediate transfer belt, the elastic layer preferably has a thickness of 50 to 300 μm.

An image forming apparatus according to an embodiment of the present invention is characterized by including the intermediate transfer belt.

The intermediate transfer belt includes a base layer and an elastic layer formed of a rubber composition and has a volume resistivity that shows a specific voltage dependency, allowing a desired level of transfer current to flow at a low voltage. The intermediate transfer belt therefore has a high ability to transfer images to recording media with irregular surface regardless of the type of the image pattern to be transferred to the recording media.

The image forming apparatus includes the intermediate transfer belt which has a high ability to transfer images to recording media with irregular surface regardless of the type of the image pattern to be transferred to the recording media. Accordingly, the image forming apparatus enables formation of high-quality visible images on recording media with irregular surface.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
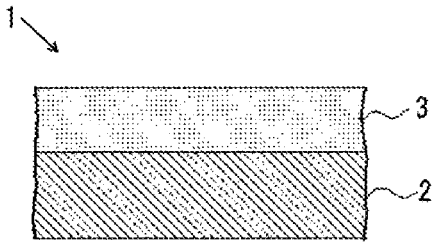
FIG. 1 is a partial cross-sectional view illustrating an example of a configuration of an intermediate transfer belt according to an embodiment of the present invention.

An embodiment of the present invention will now be described.

[Intermediate Transfer Belt]

An intermediate transfer belt according to an embodiment of the present invention is applicable to an electrophotographic image forming apparatus and is formed of at least two layers: a base layer, and an elastic layer. The presence of an elastic layer confers elasticity to the intermediate transfer belt; therefore, even when a recording medium has irregularities on the surface on which a visible image is to be formed, the intermediate transfer belt deforms to follow the irregularities.

Further, from the perspective of followability to the surface irregularities of recording media, it is preferable that a surface of the intermediate transfer belt, on which a toner image to be transferred to a recording medium is to be formed, is composed of a surface of the elastic layer.

The intermediate transfer belt satisfies the following Expression (1), when its volume resistivity when a voltage of 100V is applied in a thickness direction thereof, i.e., a direction in which the base layer and elastic layer are laminated is defined as ρv100[Ω·cm] and its volume resistivity when a voltage of 1000V is applied in the thickness direction thereof is defined as ρv1000[Ω·cm]:

$$1.30 \leq [\mathrm{Log}(\rho v100)/\mathrm{Log}(\rho v1000)] \leq 2.50 \quad \text{Expression (1)}$$

[Log(ρv100)/Log(ρv1000)] in Expression (1) is a measure of voltage dependency of the volume resistivity of the intermediate transfer belt. The greater the value of [Log(ρv100)/Log(ρv1000)], the more the volume resistivity of the intermediate transfer belt becomes dependent on voltage.

When the intermediate transfer belt satisfies the Expression (1), not only the need to apply a high voltage to the intermediate transfer belt in order for a desired level of transfer current to flow between the intermediate transfer belt and the recording medium is eliminated, but the transfer current can be readily controlled. Accordingly, a desired level of transfer current is allowed to flow between the intermediate transfer belt and the recording medium at a low voltage. More specifically, in an image forming apparatus, a transfer current is allowed to flow between the intermediate transfer belt and the recording medium by application of a voltage to the intermediate transfer belt, resulting in the generation of a transfer electric field which causes transfer of toner on the intermediate transfer belt to the recording medium. The level of transfer current needs to be controlled by adjusting the level of voltage to be applied to the intermediate transfer belt so that a transfer current of the order of several micro amperes flows between the intermediate transfer belt and the recording medium. When the intermediate transfer belt satisfies the Expression (1), only a required level of transfer current can flow between the intermediate transfer belt and the recording medium without having to apply to the intermediate transfer belt so high a voltage high that electrically charges the toner which forms a toner image formed on the intermediate transfer belt. Moreover, the level of transfer current can be controlled without fail by means of voltage to be applied to the intermediate transfer belt.

On the other hand, when the value of [Log(ρv100)/Log(ρv1000)] is less than 1.30, the volume resistivity of the intermediate transfer belt becomes less dependent on voltage. Thus, in order for a desired level of transfer current to flow between the intermediate transfer belt and the recording medium, it is required to apply a high voltage to the intermediate transfer belt. Hence, particularly when forming a black halftone image, i.e., when the toner image formed on the intermediate transfer belt has a portion with a low density of black toner (portion that shows a low resistivity), the toner charge amount is small when charges are imparted to toner particles. Accordingly, the resultant visible image tends to have a poorly-transferred black halftone image, i.e., feels rough. When the value of [Log(ρv100)/Log(ρv1000)] is greater than 2.50, the volume resistivity of the intermediate transfer belt becomes more dependent on voltage, and therefore a transfer current is controllable only with difficulty. This results in an instable transfer electric field generating between the intermediate transfer belt and the recording medium, and therefore the resultant visible image tends to have a poorly-transferred, low-density black halftone image, i.e., feels rough.

Volume resistivity ρv100 and volume resistivity ρv1000 are measured with a resistivity meter in the manner described hereinafter. First, a measurement sample is prepared by cutting the intermediate transfer belt to a width of 360 mm. A desired level of voltage (specifically, 100V or 1000V) is applied to a total of 12 points (regularly spaced 3 points along the width×regularly spaced 4 points along the length) of the measurement sample in its thickness direction (direction in which the base layer and elastic layer are laminated), each point is measured for volume resistivity 10 seconds after the initiation of voltage application, and an average of the measured values is calculated. Application of voltage to the measurement sample is accomplished by contacting the measurement sample to the two electrode plates of the resistivity meter at a position between the electrodes. Hiresta IP (probe: HP, Mitsubishi Chemical Analytech Co., Ltd.) is usable as the resistivity meter, for example.

The intermediate transfer belt is specifically a belt that includes base layer 2 and elastic layer 3 formed on base layer 2, as illustrated for example in FIG. 1. In the example illustrated in FIG. 1, intermediate transfer belt 1 is an endless belt that includes a seamless belt, a base, as base layer 2.

(Base Layer)

Base layer 2 is preferably formed of a resin composition in which a conductive filler is dispersed in a resin component.

The resin component for base layer 2 is preferably a super engineering plastic such as polyimide resin (PI), polyamideimide resin (PAI), polyphenylenesulfide resin (PPS), or polyetheretherketone resin (PEEK) from the perspective of mechanical strength and durability.

The conductive filler for base layer 2 is preferably formed of carbon black, carbon nanotube, carbon nanofiber or the like.

The proportion of the conductive filler in base layer 2 is appropriately determined in view of, for example, the type of resin component, thickness of base layer 2, and configuration of elastic layer 3.

Base layer 2 may have a single-layer structure as illustrated in FIG. 1 or may have a multilayer structure wherein two or more layers are laminated.

Base layer 2 preferably has a thickness of 50 to 250 μm from the perspective of mechanical strength and production costs.

(Elastic Layer)

Elastic layer 3 is formed of a rubber composition. The rubber composition for elastic layer 3 preferably contains a conductive filler dispersed in a rubber component. When a rubber composition for elastic layer 3 contains a conductive filler dispersed in a rubber component, the volume resistivity (more specifically, volume resistivity ρv100 and volume resistivity ρv1000) of intermediate transfer belt 1 can be readily controlled by adjusting the proportion of the conductive filler.

Any rubber component can be used for elastic layer 3; examples thereof include, but not limited to, crosslinked rubber materials such as chloroprene rubber (CR), nitrile rubber (NBR), and epichlorohydrin rubber (ECO). These rubber materials may be used singly or in combination.

The conductive filler for elastic layer 3 is preferably carbon black, carbon nanotube or the like from the perspective of electron conductivity and control of the volume resistivity of intermediate transfer belt 1.

The proportion of the conductive filler in elastic layer 3 is appropriately determined in view of, for example, the type of rubber component, thickness of elastic layer 3, and configuration of base layer 2.

Elastic layer 3 preferably has a thickness of 50 to 300 μm, more preferably 200 to 300 μm.

When elastic layer 3 has a thickness of 50 to 300 μm, intermediate transfer belt 1 has a high image transfer function. Moreover, when elastic layer 3 has a thickness of 200 μm or more, intermediate transfer belt 1 is provided with a higher ability to transfer images to recording media particularly where a visible image to be formed includes a solid image with high toner content (solid image formed of superimposed toner images).

On the other hand, when the thickness of elastic layer 3 is too small, intermediate transfer belt 1 is not sufficiently elastic, which may result in intermediate transfer belt 1 failing to have a superior ability to transfer images to recording media with irregular surface. When the thickness of elastic layer 3 is too large, expansion of the transfer electric field generated between intermediate transfer belt 1 and the recording medium becomes excessive. This may cause image distortion and may result in failure to provide high-quality visible images.

Further, when the surface of elastic layer 3 constitutes the surface of intermediate transfer belt 1 as illustrated in FIG. 1, the coefficient of friction of elastic layer 3 is preferably adjusted from the perspective of image transfer function. The surface of elastic layer 3 preferably has a coefficient of friction of 0.3 to 0.7.

Intermediate transfer belt 1 with such a configuration is enabled to satisfy Expression (1) by controlling its volume resistivity (more specifically volume resistivity ρv100 and volume resistivity ρv1000) for example by adjusting the proportion of the conducting agent in base layer 2 and the proportion of the conductive filler in elastic layer 3.

[Manufacturing Method for Intermediate Transfer Belt]

Intermediate transfer belt 1 can be manufactured for example by dip coating of a base for base layer 2 with a coating solution for elastic layer 3, drying the coated film thus formed, and optionally subjecting the coated film with surface treatment as needed. For the base, it is possible to employ a seamless belt made of resin containing a conducting agent (conductive filler). For the coating solution for elastic layer, it is possible to employ, for example, a coating solution prepared by dissolving a mixture of rubber material and conductive filler in organic solvent such as toluene. Surface treatment may be light irradiation treatment.

Intermediate transfer belt 1 manufactured in the manner described above includes base layer 2 and elastic layer 3 formed of a rubber composition, and has a volume resistivity that shows a specific voltage dependency; specifically, intermediate transfer belt 1 satisfies the Expression (1). Accordingly, intermediate transfer belt 1 allows a desired level of transfer current to flow at a low voltage. Intermediate transfer belt 1 therefore has a high ability to transfer images to recording media with irregular surface regardless of the type of the image pattern to be transferred to the recording media.

[Image Forming Apparatus]

An intermediate transfer belt with the configuration described above can be suitably used in various types of electrophotographic image forming apparatus known in the art, including monochrome and full-color image forming apparatus.

Figure 2:
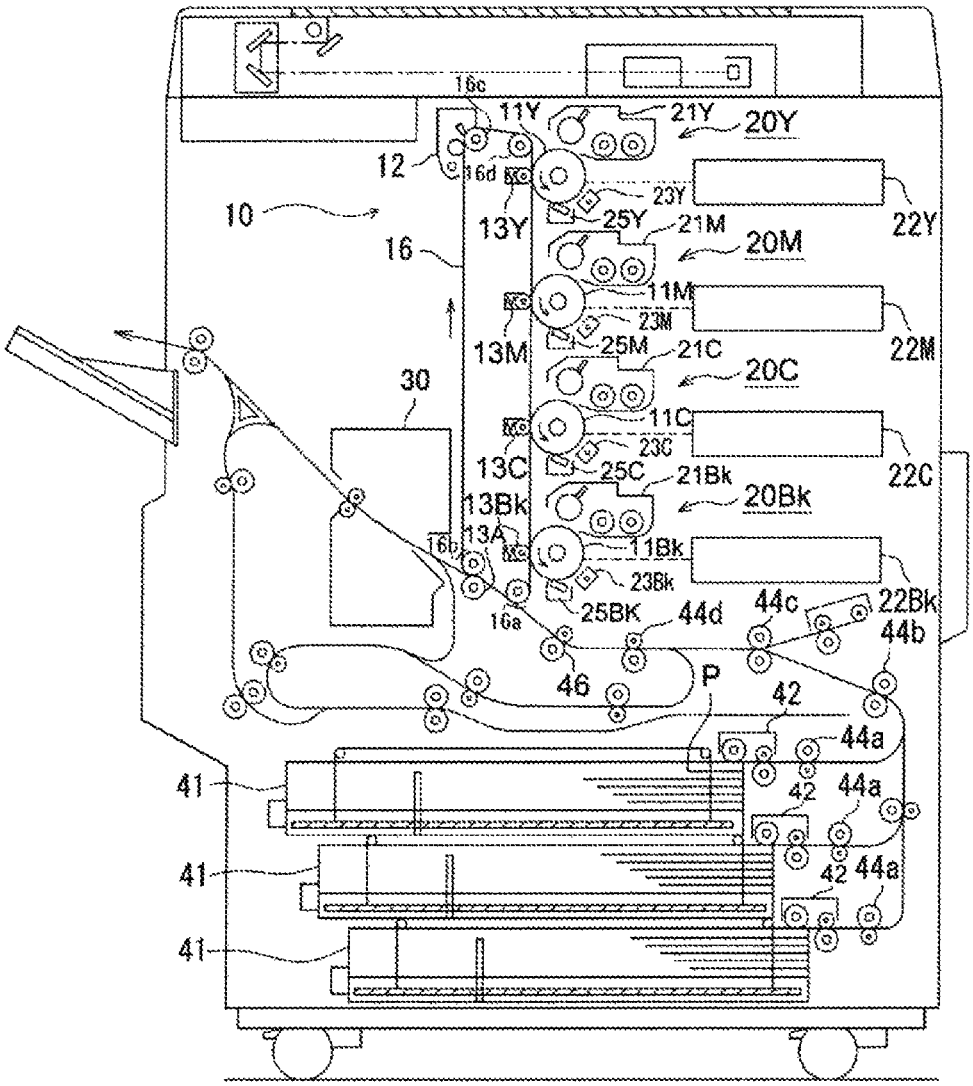
FIG. 2 is a schematic view illustrating an example of a configuration of an image forming apparatus according to an embodiment of the present invention.

FIG. 2 is an explanatory cross-sectional view illustrating an example of a configuration of an image forming apparatus equipped with the intermediate transfer belt.

The image forming apparatus includes image forming units 20Y, 20M, 20C and 20Bk; intermediate transfer section 10 for transferring toner images, formed in respective image forming units 20Y, 20M, 20C and 20Bk, onto recording medium P; and fixing device 30 for performing a fixing process wherein recording medium P is pressed under heating to fix the toner images to recording medium P to form toner layers.

Yellow toner images are formed in image forming unit 20Y, magenta toner images in image forming unit 20M, cyan toner images in image forming unit 20C, and black toner images in image forming unit 20Bk.

Image forming units 20Y, 20M, 20C and 20Bk respectively include: photoconductors 11Y, 11M, 11C and 11Bk, electrostatic latent image bearing members; charging sections 23Y, 23M, 23C and 23Bk for supplying an even potential over the surface of photoconductors 11Y, 11M, 11C and 11Bk; exposing sections 22Y, 22M, 22C and 22Bk for forming electrostatic latent images of desired shape on the evenly charged photoconductors 11Y, 11M, 11C and 11Bk; developing sections 21Y, 21M, 21C and 21Bk for visualizing the electrostatic latent images by delivering toners (specifically, yellow toner, magenta toner, cyan toner, and black toner) onto photoconductors 11Y, 11M, 11C and 11Bk; and cleaning sections 25Y, 25M, 25C and 25Bk for recovering the residual toners on the photoconductors 11Y, 11M, 11C and 11Bk after primary transfer.

Intermediate transfer section 10 includes: rotatable intermediate transfer belt 16; primary transfer rollers 13Y, 13M, 13C and 13Bk as primary transfer sections for transferring toner images, formed by image forming units 20Y, 20M, 20C and 20Bk, onto intermediate transfer belt 16; secondary transfer roller 13A as a secondary transfer section for transferring the color toner images, transferred onto intermediate transfer belt 16 by primary transfer rollers 13Y, 13M, 13C and 13Bk, onto recording medium P; and cleaning section 12 for recovering the residual toner on intermediate transfer belt 16.

Intermediate transfer belt 16 is the intermediate transfer belt, which is an endless belt stretched over support rollers 16*a* to 16*d* and which is rotatably supported. It is to be noted that intermediate transfer belt 16 includes an elastic layer formed of a rubber composition provided on a base layer, and satisfies the Expression (1).

Toner images of different four colors respectively produced by image forming units 20Y, 20M, 20C and 20Bk are sequentially transferred onto rotating intermediate transfer belt 16 by primary transfer rollers 13Y, 13M, 13C and 13Bk, to form thereon a superimposed color image. By sheet feed section 42, recording media P stored in sheet cassette 41 are fed sheet-by-sheet through feed rollers 44*a* to 44*d* and registration roller 46 to secondary transfer roller 13A, a secondary transfer section, where the color image is transferred onto recording medium P at a time. Recording medium P on which the color image has been transferred is then subjected to fixation treatment by fixing device 30 equipped with thermal fixing rollers and is ejected onto an external sheet tray by sheet ejection rollers. On the other hand, endless intermediate transfer belt 16 from which recording medium P has been separated by self-stripping after transfer of the color image onto recording medium P by secondary transfer roller 13A is cleared from residual toner by means of cleaning section 12.

An image forming apparatus with the configuration described above includes the intermediate transfer belt, wherein the intermediate transfer belt has a high ability to transfer images to recording media with irregular surface regardless of the type of the image pattern to be transferred to the recording media. Accordingly, with the image forming apparatus according to an embodiment of the present invention, since the intermediate transfer belt has a superior image transfer function as well as high durability, it is possible to form high-quality visible images on recording media with irregular surface.

[Developers]

Developers for use in the image forming apparatus may be either single-component developers consisting of magnetic or non-magnetic toner, or two-component developers consisting of a mixture of toner and carrier. Any of the various toners known in the art can be used as the toner for the developers. It is preferable to employ, for example, so-called polymerization toners obtained by polymerization methods, with a volume-based median particle diameter of 3 to 9 μm. Use of polymerization toner not only makes it possible to provide visible images with high resolution and stable image density, but also significantly reduces the occurrence of image fogging.

Any of the various carriers known in the art can be used as the carrier for the two-component developers. It is preferable to employ, for example, a ferrite carrier formed of magnetic particles with a volume-based median particle diameter of 30 to 65 μm and a magnetization of 20 to 70 emu/g. When a carrier with a volume-based median particle diameter of less than 30 μm is used, there is concern that images with blanks result due to attachment of carrier. When a carrier with a volume-based median particle diameter of greater than 65 μm is used, images with uniform image density may not be formed.

[Recording Media]

Examples of recording media P for use in the image forming apparatus include, but not limited to, plain paper ranging from thin to thick, wood-free paper, coated printing paper such as art paper and coated paper, commercially available Japanese paper and postcard paper, embossed paper, plastic films for overhead projectors, and fabrics. Recording media with irregular surface, such as embossed paper, Japanese paper and fabrics, are preferable as recording media P for use in the image forming apparatus.

An embodiment of the present invention has been described in detail above. It should be appreciated that many alternatives, variations, and modifications can be made without departing from the spirit and scope of the present invention.

EXAMPLES

The following describes specific Examples of the present invention, which however shall not be construed as limiting the scope of the present invention.

[Manufacturing Example 1 for Intermediate Transfer Belt]

(1) Preparation of Base Layer

A 60 μm-thick seamless belt was prepared which is made of polyimide containing 8 wt % of conductive filler formed of carbon nanofiber. The seamless belt was used as Base [1] for the base layer of an intermediate transfer belt.

(2) Formation of Elastic Layer 80 parts by mass of chloroprene rubber as rubber material and 20 parts by mass of carbon black (Asahi Thermal, Asahi Carbon Co., Ltd.) as conductive filler were mixed, and the resultant mixture was dissolved in toluene to prepare Coating Solution [1] for elastic layer. Coating Solution [1] thus prepared was applied over the outer surface of Base [1] by dip coating. After drying the coated film formed, the dried coated film was irradiated with light under the light irradiation condition described below to form an elastic layer of 200 μm thickness. In this way Intermediate Transfer Belt [1] was obtained. Using a resistivity meter (Hiresta IP, probe: HP, Mitsubishi Chemical Analytech Co., Ltd.), Intermediate Transfer Belt [1] was measured for its volume resistivity ρv100 and volume resistivity ρv1000 in the manner described above. Using the measured values of volume resistivity ρv100 and volume resistivity ρv1000, a value of [Log(ρv100)/Log(ρv1000)] was calculated. The result is given in Table 1.

[Light Irradiation Condition]

Light Source: high-pressure mercury lamp ("H04-L41", EYE GRAPHICS Co., Ltd.)

Light Irradiation Distance (distance from the light emission port to the surface of coated film): 100 mm Irradiation Dose: 1 J/cm$^2$ Irradiation Time (rotation time of base): 240 seconds

[Manufacturing Examples 2 to 9 for Intermediate Transfer Belt]

Intermediate Transfer Belts [2] to [9] were obtained as in Manufacturing Example 1 except that in the process for forming an elastic layer in Manufacturing Example 1 coating solutions for elastic layer were prepared in accordance with the formulations given in Table 1 and elastic layers having thicknesses given in Table 1 were formed using the respective coating solutions. Values of [Log(ρv100)/Log(ρv1000)] were calculated for Intermediate Transfer Belts [2] to [9] in the same manner as that used in Manufacturing Example 1. The results are given in Table 1.

Examples 1 to 5 and Comparative Examples 1 to 4

Intermediate Transfer Belts [1] to [9] were each mounted on image forming apparatus (KONICA Minolta bizhub PRESS C8000, Konica Minolta, Inc.) as the intermediate transfer belt. Using embossed paper (Lezak 302 g) as recording media, the following evaluation tests were conducted. The results are given in Table 1.

[Evaluation of Image Quality of Blue Solid Image]

The image forming apparatus was operated to output a blue solid image composed of cyan and magenta toner images. The amount of toner on the intermediate transfer belt on which a toner image to be transferred to a recording medium (specifically, a toner image in which cyan and magenta toner images are superimposed) is formed, i.e., the amount of toner on the belt before transfer, and the amount of toner on the intermediate transfer belt after transfer of the toner image onto the recording medium, i.e., the amount of toner on the belt after transfer were measured. Using the following Equation (1), transfer ratio was calculated, and the quality of the blue solid blue image was evaluated based on the evaluation criteria given below.

$$\text{Transfer ratio (\%)} = (1 - \text{toner amount (g) on belt before transfer}/\text{toner amount (g) on belt after transfer}) \times 100 \quad \text{Equation (1)}$$

[Evaluation Criteria for Solid Blue Image]

[A]: transfer ratio: ≥95%

[B]: transfer ratio: 93% to less than 95%

[C]: transfer ratio: 90% to less than 93%

[D]: transfer ratio: <90% with different hue

[Evaluation of Image Quality of Black Halftone Image]

The image forming apparatus was operated to output a black halftone image over the entire surface of an embossed paper sheet, and the quality of the black halftone image was evaluated based on the following criterial by visual inspection of the visible image.

[Evaluation Criteria for Image Quality of Black Halftone Image]

[A]: No color unevenness

[B]: Practically acceptable level of color unevenness

[C]: Practically problematic level of color unevenness

TABLE 1

| | Intermediate Transfer Belt | | | | | Results of Evaluation Tests | |
|---|---|---|---|---|---|---|---|
| | Conductive Filler | | | | | | |
| | No. | Type | Content (parts by mass) | Log(ρv100)/Log(ρv1000) | Thickness of Elastic layer [μm] | Evaluation of Blue Solid Image | Evaluation of Black Halftone Image |
| Ex. 1 | 1 | Carbon Black (1) | 20 | 1.95 | 200 | A | A |
| Ex. 2 | 2 | Carbon Black (1) | 18 | 1.35 | 200 | A | A |
| Ex. 3 | 3 | Carbon Black (1) | 25 | 2.45 | 200 | A | A |
| Ex. 4 | 4 | Carbon Black (1) | 20 | 1.95 | 60 | B | A |
| Ex. 5 | 5 | Carbon Black (1) | 20 | 1.95 | 290 | A | A |
| Comp. Ex. 1 | 6 | Tetrabutylammonium hydrogensulfate | 5 | 1.25 | 200 | C | C |
| Comp. Ex. 2 | 7 | Carbon Black (2) | 20 | 2.55 | 200 | C | C |
| Comp. Ex. 3 | 8 | Tetrabutylammonium hydrogensulfate | 5 | 1.25 | 40 | D | C |
| Comp. Ex. 4 | 9 | Carbon Black (2) | 20 | 2.55 | 310 | B | C |

In Table 1, "Carbon Black (1)" refers to "Asahi Thermal" (Asahi Carbon Co., Ltd.), and "Carbon Black (2)" to "Special Black 4 (Evonik Industries AG). It is to be also noted in Table 1 that "tetrabutylammonium hydrogensulfate" is an ionic conducting agent.

As evident from the results given in Table 1, the image forming apparatus according to Examples 1 to 5 exhibited a high ability to transfer, from the intermediate transfer belt to a recording medium with irregular surface, both of a solid image of two superimposed layers with high toner content (specifically, a solid image formed of superimposed magenta and cyan toner images) and a black halftone image with low toner content. It was thus confirmed that these image forming apparatus can provide high-quality visible images.

REFERENCE SIGNS LIST

1 Intermediate transfer belt
2 Base layer
3 Elastic layer
10 Intermediate transfer section
11Y, 11M, 11C, 11Bk Photoconductor
12 Cleaning section
13Y, 13M, 13C, 13Bk Primary transfer roller
13A Secondary transfer roller
16 Intermediate transfer belt
16*a* to 16*d* Support roller
20Y, 20M, 20C, 20Bk Image forming unit
21Y, 21M, 21C, 21Bk Developing section
22Y, 22M, 22C, 22Bk Exposing section
23Y, 23M, 23C, 23Bk Charging section
25Y, 25M, 25C, 25Bk Cleaning section
30 Fixing device
41 Sheet cassette
42 Sheet feed section
44*a*, 44*b*, 44*c*, 44*d* feed roller
46 Registration roller
N1 Fixing nip
P Recording media

What is claimed is:

1. An intermediate transfer belt comprising:

a base layer; and an elastic layer formed on the base layer, the elastic layer being formed of a rubber composition, wherein the intermediate transfer belt satisfies the following Expression (1):

$$1.30 \leq [\mathrm{Log}(\rho v100)/\mathrm{Log}(\rho v1000)] \leq 2.50 \qquad \text{Expression (1)}$$

where ρv100 represents a volume resistivity [Ω·cm] of the intermediate transfer belt when a voltage of 100V is applied to the intermediate transfer belt in a thickness direction thereof, and ρv1000 represents a volume resistivity [Ω·cm] of the intermediate transfer belt when a voltage of 1000V is applied to the intermediate transfer belt in the thickness direction thereof.

2. The intermediate transfer belt according to claim 1, wherein the elastic layer has a thickness of 50 to 300 μm.

3. An image forming apparatus comprising the intermediate transfer belt according to claim 1.

4. An image forming apparatus comprising the intermediate transfer belt according to claim 2.

* * * * *